US007481872B1

(12) United States Patent
Devine et al.

(10) Patent No.: US 7,481,872 B1
(45) Date of Patent: Jan. 27, 2009

(54) PROCESS FOR MAKING BATH COMPOSITION FOR CONVERTING SURFACE OF FERROUS METAL TO MIXED OXIDES AND ORGANOMETALLIC COMPOUNDS OF ALUMINUM AND IRON

(75) Inventors: Bryce D. Devine, St. Paul, MN (US); William V. Block, Apple Valley, MN (US)

(73) Assignee: Birchwood Laboratories, Inc., Eden Prairie, MN (US)

( * ) Notice: Subject to any disclaimer, the term of this patent is extended or adjusted under 35 U.S.C. 154(b) by 202 days.

(21) Appl. No.: 11/528,173

(22) Filed: Sep. 27, 2006

Related U.S. Application Data

(62) Division of application No. 10/892,663, filed on Jul. 15, 2004, now Pat. No. 7,144,599.

(51) Int. Cl.
*C23F 11/04* (2006.01)
*C23F 11/12* (2006.01)
*C23F 11/14* (2006.01)
*C23F 11/18* (2006.01)

(52) U.S. Cl. ..... 106/14.13; 106/14.11; 106/14.12; 106/14.41; 106/14.42; 106/14.43; 106/14.44

(58) Field of Classification Search ..... 427/327, 427/387
See application file for complete search history.

(56) References Cited

U.S. PATENT DOCUMENTS 2,148,331 A 2/1939 Weisberg et al.

(Continued)

FOREIGN PATENT DOCUMENTS

DE 2623604 12/1976

(Continued)

OTHER PUBLICATIONS

Jun. 9, 2008 Non-Final Office Action in co-pending U.S. Appl. No. 11/527,825, "Bath Composition for Converting Surface of Ferrous Metal to Mixed Oxides and Organometallic Compounds of Aluminum and Iron," (19 pages).

(Continued)

*Primary Examiner*—Jennifer McNeil
*Assistant Examiner*—Yoshitoshi Takeuchi
(74) *Attorney, Agent, or Firm*—Pauly, DeVries Smith & Deffner, L.L.C.

(57) ABSTRACT

The ferrous metal chemical conversion coating is comprised of mixed oxides and organometallic compounds of aluminum and iron. A ferrous metal substrate is immersed for a period of time in a bath composition, at a temperature, at a pH, and at a concentration for each constituent of the bath composition, that will form a coating with the desired characteristics. The bath composition comprises water, aluminum salt, oxalic acid, and an oxidizer. The conversion coating is amorphous in nature and can be formed as thin as 1 micron with a coating weight in the range of about 40-250 milligrams per square foot. When sealed with an appropriate rust preventive material, the coating enhances corrosion resistance of the ferrous metal substrate. It is an effective absorbent base for paint finishes. When top coated with a lubricant, the conversion coating aids (a) assembly of parts, (b) break-in of sliding surfaces, and (c) anti-galling.

1 Claim, 5 Drawing Sheets

A Scanning Electron Micrograph Of The Coating At 5000X Magnification

Secondary Electron Image Magnification: 5000X

U.S. PATENT DOCUMENTS

| | | | | |
|---|---|---|---|---|
| 2,774,696 | A | | 12/1956 | Gibson |
| 2,791,525 | A | * | 5/1957 | Rausch et al. ..... 148/252 |
| 2,805,969 | A | | 9/1957 | Goodspeed et al. |
| 2,817,610 | A | | 12/1957 | Newell et al. |
| 2,835,616 | A | | 5/1958 | Rausch et al. |
| 2,850,417 | A | | 9/1958 | Jenkins et al. |
| 2,960,420 | A | | 11/1960 | Mitchell |
| 3,053,691 | A | | 9/1962 | Hartman et al. |
| 3,053,692 | A | | 9/1962 | Pocock |
| 3,083,149 | A | | 3/1963 | Cranston |
| 3,121,033 | A | | 2/1964 | Stapleton |
| 3,346,522 | A | | 10/1967 | Schuster et al. |
| 3,481,762 | A | | 12/1969 | Streicher |
| 3,559,280 | A | | 2/1971 | Mailhiot et al. |
| 3,598,659 | A | | 8/1971 | Klingler et al. |
| 3,632,452 | A | | 1/1972 | Matsushima et al. |
| 3,649,371 | A | | 3/1972 | Tongyai |
| 3,658,603 | A | | 4/1972 | Boyer |
| 3,666,468 | A | * | 5/1972 | Amano et al. ..... 430/432 |
| 3,677,827 | A | | 7/1972 | Weaver et al. |
| 3,706,604 | A | | 12/1972 | Plaxton |
| 3,709,742 | A | | 1/1973 | Jacobs |
| 3,753,942 | A | | 8/1973 | Moran et al. |
| 3,806,375 | A | | 4/1974 | McLeod et al. |
| 3,879,237 | A | | 4/1975 | Faigen |
| 3,899,367 | A | | 8/1975 | Mitchell |
| 3,929,514 | A | | 12/1975 | Houlihan et al. |
| 3,936,445 | A | | 2/1976 | Pfitzner et al. |
| 4,006,041 | A | | 2/1977 | Fabregas et al. |
| 4,017,335 | A | | 4/1977 | Maloney |
| 4,018,934 | A | | 4/1977 | Parliment |
| 4,086,182 | A | | 4/1978 | Hengelhaupt et al. |
| 4,140,551 | A | | 2/1979 | Jones |
| 4,246,030 | A | | 1/1981 | Lipinski |
| 4,296,182 | A | | 10/1981 | Matsubayashi et al. |
| 4,298,405 | A | | 11/1981 | Saus et al. |
| 4,565,585 | A | | 1/1986 | Matsuda |
| 4,591,397 | A | | 5/1986 | Jones et al. |
| 4,728,365 | A | | 3/1988 | Jarvi |
| 4,781,948 | A | | 11/1988 | Caldwell |
| 4,789,409 | A | | 12/1988 | Jarvi |
| 4,794,139 | A | | 12/1988 | Braden et al. |
| 4,806,161 | A | | 2/1989 | Fabiny et al. |
| 4,944,812 | A | | 7/1990 | Lindert et al. |
| 5,089,349 | A | | 2/1992 | Kaiser |
| 5,104,463 | A | | 4/1992 | Menke |
| RE34,272 | E | | 6/1993 | Michaud et al. |
| 5,320,872 | A | | 6/1994 | McNeel et al. |
| 5,466,297 | A | | 11/1995 | Goodman et al. |
| 5,580,063 | A | | 12/1996 | Edwards |
| 5,591,275 | A | | 1/1997 | Miyafuji et al. |
| 5,601,663 | A | | 2/1997 | Rungta et al. |
| 5,667,599 | A | | 9/1997 | Rungta et al. |
| H1700 | H | * | 12/1997 | Morishima et al. ..... 430/436 |
| 5,704,995 | A | | 1/1998 | Bradley |
| 5,723,183 | A | | 3/1998 | Williams et al. |
| 5,919,318 | A | | 7/1999 | Brands et al. |
| 6,171,409 | B1 | | 1/2001 | Hamacher et al. |
| 6,193,815 | B1 | | 2/2001 | Wada et al. |
| 6,277,214 | B1 | | 8/2001 | Akhtar et al. |
| 6,309,476 | B1 | | 10/2001 | Ravenscroft et al. |
| 6,527,873 | B2 | | 3/2003 | Ravenscroft et al. |
| 6,576,346 | B1 | | 6/2003 | Ravenscroft et al. |
| 7,144,599 | B2 | | 12/2006 | Block et al. |
| 2002/0079269 | A1 | * | 6/2002 | Sassaman et al. ..... 210/666 |
| 2003/0079807 | A1 | | 5/2003 | Ravenscroft et al. |

FOREIGN PATENT DOCUMENTS

| | | |
|---|---|---|
| DE | 4217098 | 11/1996 |
| EP | 264471 | 4/1988 |
| EP | 264472 | 4/1988 |
| JP | 6427938 | 1/1989 |

OTHER PUBLICATIONS

Birchwood Laboratories, Inc. "Safe, Low Cost, In-house Blackening with the Presto® Black Process," Birchwood Laboratories, Inc., no date (6 pages).

Birchwood Casey, "Guide to Room Temperature Antiquing without Hazardous Effluent";Birchwood Casey; Eden Prairie, MN (no date).

Birchwood Casey, "In-House Blackening with No EPA Regulated Chemicals"; Birchwood Casey; Eden Prairie, MN (No Date).

Birchwood Casey, "Your Practical Guide and cost Analysis"; Birchwood Casey; Eden Prairie, MN; Aug. 1997.

Cotton, F. Albert and Wilkinson, Geoffrey, "Advanced Inorganic Chemistry A comprehensive Text", Interscience Publishers, NY, pp. 847-863, (1962, no month).

Daniels, Christopher; "Black-Oxide Basics: Improved protection, appearance and performance with black oxide finishes", Products Finishing; Jul. 1992.

DUR-LITE, "DULITE® Guide to Hot Black Oxide Processes", The Du-Lite Corporation; Middletown CT; 1994 (no month).

Godding, A. D.; "The Basics of Black Oxide Finishing: Why to do it, how to do it, applications and advantages", Products Finishing; Feb. 1990.

Godding, A. D.; "Why Black Oxide? Here's how and why", Products Finishing; Apr. 1986.

Heatbath Corporation. "It Doesn't Get Any Blacker than This" with supporting pages from www.heatbath.com/black-oxide-finishing.htm ; Finisher's Management et al, Mar. 1996.

Hubbard-Hall, "Activated Black Magic 'Plus': The cutting edge for quality and performance when hot black oxiding steel;" Hubbard-Hall; Waterbury, CT (no date).

Hubbard-Hall, "Activated Black Magic Plus" http://www.hubbard-hall.com/files/2232001.pdf; Hubbard-Hall, Waterbury, CT; 2003.

Ruhland, Mark; "Blackening of Ferrous Metals;" Birchwood Casey and PF Directory; Eden Prairie, MN, (1999; no month).

National Toxicology Program; "Thiourea—CAS No. 62-56-6: First listed in the Third Annual Report on Carcinogens"; Tenth Report on Carcinogens; date unknown.

Radian Corporation; "N,N'-Diethylthiourea", NTP Chemical Repository (Radian Corporation); Aug. 29, 1991.

Birchwood Casey, "Material Safety Data Sheet: Presto® Black Brush-On BST4"; Birchwood Laboratories, Inc.; Eden Prairie, MN ; Apr. 2, 2001.

* cited by examiner

A Scanning Electron Micrograph Of The Coating At 5000X Magnification

Secondary Electron Image Magnification: 5000X

An EDS Spectrum Of The Coating

Figure 3

Surface Chemistry Of The Coating By Electron Spectroscopy For Chemical Analysis

Table 1. ESCA atomic concentration summary (atomic percent).

| Sample | [C] | [O] | [Al] | [Cu] | [Fe] | [N] | [P] | [S] |
|---|---|---|---|---|---|---|---|---|
| 20 min | 20.9 | 58.3 | 15.9 | 0.1 | 1.0 | .9 | .8 | 2.1 |
| 40 min | 16.3 | 60.9 | 15.9 | ND | 3.9 | 0.5 | ND | 2.5 |

ND – Not Detected

Table 2. Carbon chemistry (relative percent).

| Sample | C-C, C-H | C-O | C=O | O-C=O |
|---|---|---|---|---|
| 20 min | 45 | 20 | 5 | 30 |
| 40 min | 38 | 16 | 3 | 43 |

Figure 4

Coating Color on Ferrous Metal Substrates

| Part | Wheel Brake Cylinder (casting) | Gear Sprocket (powder metal) | Slotted L-stamping (steel) | Tie Rod End (forging) | ½ inch Hexagonal Nut | Polished Steel Tubing ¾ inch | Forged Wrench (Allen Hexagonal) | Sheet Steel Panel |
|---|---|---|---|---|---|---|---|---|
| Mass (gm) | 329.0 | 365.0 | 6.7 | 514.4 | 24.6 | 116.8 | 86.3 | 66.4 |
| Temp (°F) | 150 | 160 | 150 | 120 | 130 | 150 | 150 | 180 |
| Time (min.) | 10-20 | 25 | 10 | 20 | 15 | 10-20 | 15 | 5 |
| Coating color | Gray | Dark gray | Gray | Gray | Gray | Gray | Dark Gray | Dark Gray |

Figure 5

Coating Weight (mg/ft$^2$)

| | 120° F | 150° F | 180° F |
|---|---|---|---|
| 10 min | 45 | 54 | 99 |
| 20 min | 53 | 88 | 185 |
| 40 min | 99 | 167 | 250 |
| | | | |

Figure 6

Salt Fog Corrosion Analysis Results

| Coating | Contact Time (min.) | Bath Temp (°F) | Sealant | Resistance Time (Hours) |
|---|---|---|---|---|
| Uncoated Steel | - | - | None | <2 |
| Aluminum Oxide | 15 | 150 | None | 8 |
| Uncoated Steel | - | - | WD | 144 |
| Aluminum Oxide | 15 | 150 | WD | >200 |
| Aluminum Oxide | 30 | 150 | WD | >200 |
| Uncoated Steel | - | - | WS | 24 |
| Aluminum Oxide | 15 | 150 | WS | 96 |
| Iron Phosphate | 10 | 130 | WS | 24 |
| Zinc Phosphate | 10 | 180 | WS | >96 |

WD = Water Displacing Sealant.
WS = Water Soluble Oil.

PROCESS FOR MAKING BATH COMPOSITION FOR CONVERTING SURFACE OF FERROUS METAL TO MIXED OXIDES AND ORGANOMETALLIC COMPOUNDS OF ALUMINUM AND IRON

This application is a divisional of prior application Ser. No. 10/892,663, filed Jul. 15, 2004, now U.S. Pat. No. 7,144,599.

FIELD OF TECHNOLOGY

The technology described in this specification relates to (a) a process of forming a chemical conversion coating on ferrous substrates ("process" or "coating process"); (b) the composition of the chemical conversion coating comprising mixed oxides and organometallic compounds of aluminum and iron ("coating composition," "conversion coating," or "coating"); (c) the composition for forming the conversion coating on the ferrous metal substrate ("bath composition"); (d) the process of making the bath composition; and (e) the coated ferrous metal substrate made by the process ("product by process").

DESCRIPTION OF DRAWINGS

FIG. 3 is an electron spectroscopy for chemical analysis of an embodiment of the conversion coating.

FIG. 4 presents test results of coating color of an embodiment of the conversion coating.

FIG. 5 presents the weight of embodiments of the conversion coating.

FIG. 6 presents test results of corrosion resistance of embodiments of the conversion coating.

DESCRIPTION OF EMBODIMENTS

Introduction

Figure 1:
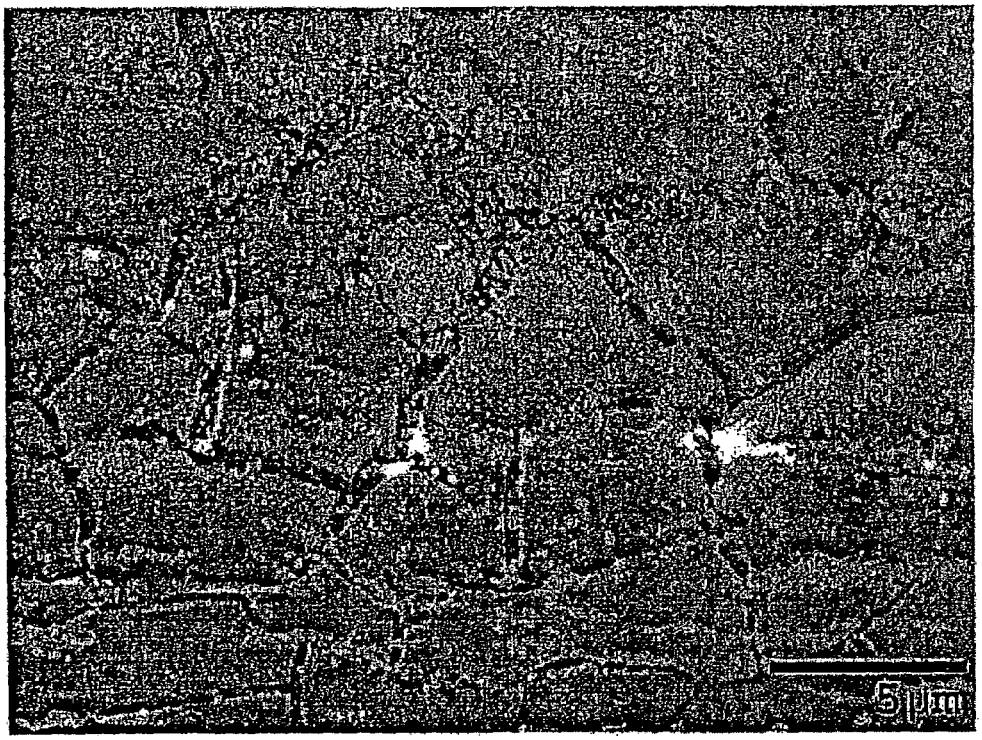
FIG. 1 is a scanning electron micrograph of an embodiment of a conversion coating.

The conversion coating described in this specification is comprised of metal oxides (primarily aluminum and iron) and organometallic aluminum and iron compounds. It is formed by the conversion of a ferrous metal surface to an insoluble coating that is integral with the surface of the ferrous metal substrate.

In this specification, ferrous metal is used in its broadest sense as would be understood by one of ordinary skill in the field of metallurgy. Without limiting the generality of the foregoing, ferrous metal includes, but is not limited to, iron (such as cast iron and wrought iron), ferrous alloys, and steel (such as carbon steels, alloy steels, and stainless steels).

The conversion coating is amorphous in nature and can be formed as thin as 1 micron with a coating weight in the range of about 40-250 milligrams per square foot. The conversion coating may be formed to be relatively clean, with no discernible rub-off.

The ferrous metal conversion coating serves several purposes. When sealed with an appropriate rust preventive material, it enhances corrosion resistance of the ferrous metal substrate. It is also an effective absorbent base for other subsequent topcoats, such as lubricants and paint finishes. When top coated with a lubricant, for example, the conversion coating (a) makes parts assembly easier, (b) aids break-in of sliding surfaces, and (c) resists galling. The conversion coating is rub and scratch resistant. It is inexpensive, forms at moderate temperatures, and uses chemicals of relatively low toxicity. The coating process is uncomplicated as is replenishment of the bath composition.

A ferrous metal substrate is contacted for a period of time in the bath composition, at a temperature, at a pH, and at a concentration for each of the constituents of the bath composition that will form a coating with the desired characteristics. The bath composition comprises water, aluminum salt, an organic acid, and an oxidizer.

The coating process operates at comparatively low temperatures, requires little maintenance and produces minimal sludge. Because it utilizes chemicals of low toxicity, it requires no waste treatment facilities and operates at a comparatively low cost.

Bath Composition

The bath composition described in this specification is used in the process of coating a ferrous metal substrate with a conversion coating composed of mixed metal (primarily aluminum and iron) oxides and organometallic compounds. The bath composition produces a coating on ferrous metals at moderate pH and temperature.

The bath composition comprises water, aluminum salt, an organic acid, and an oxidizer. It may also comprise ferrous sulfate as a source of soluble iron (II).

The aluminum salt is the source of aluminum in the coating and can be any aluminum salt that is water-soluble below pH 3.5. For example, the aluminum salt may be aluminum sulfate (commonly known as alum), which is water-soluble, economical, and readily available.

The organic acid serves as a complexor for the aluminum ions in solution and also becomes part of the deposit. The choice of organic acid affects the coating properties and solution stability. Without the organic acid, aluminum hydroxide precipitates at a pH of above 3.5, leading to thin brown colored coatings composed mainly of iron oxides. Certain dicarboxylic acids, such as oxalic acid, form stable solutions up to a pH of about 5 and produce dark gray organometallic coatings. Strong complexors, such as citric and tartaric acids, form very stable solutions and produce a brightened white surface on ferrous metal substrates.

The oxidizer accelerates the reaction and is necessary to produce gray colored coatings. Oxidizers may be selected from water-soluble organic nitro compounds, such as nitrobenzenesulfonic acid and the alkali metal salts thereof, or nitrobenzene, dinitrobenzene, nitroaniline, nitroguanidene; or other inorganic materials, including for example, hydroxylamine salts such as hydroxylamine sulfate.

Ferrous sulfate is a source of soluble iron (II), which accelerates break-in of the bath composition. The use of any water-soluble iron (II) salt is suitable for this purpose. Use of these salts is optional because the bath composition will acquire, within a short period of time, some build-up of soluble iron (II) from the ferrous metal substrate itself.

An embodiment of an aqueous bath composition comprises: (a) water, (b) aluminum sulfate, $Al_2(SO_4)_3.18H_2O$ at a concentration of about 15 grams per liter; (c) oxalic acid, $(COOH)_2$ at a concentration of about 10 grams per liter; (d) sodium m-nitrobenzenesulfonate at a concentration of about 3 grams per liter; and (e) ferrous sulfate, $FeSO_4$ at a concentration of about 0.1 grams per liter. The molar ratio of oxalic acid to aluminum of this embodiment is about 2.5.

The bath composition for immersion may be made-up by directly adding the bath composition constituents to the requisite amount of water. Alternatively, a bath composition concentrate may be made-up and then added to a requisite amount of water to create the bath composition. An embodiment of the bath composition is 10% concentrate to 90% water.

Heated tanks may be insulated with 1-2 inches of insulation to minimize heat loss and thereby maintain a more stable process temperature.

Coating Process

An embodiment of the process of coating a ferrous metal substrate comprises immersing the ferrous metal substrate in a bath composition with a concentration of each of its constituents in an amount, for a period of time, at a temperature, and at a pH that will produce a mixed metal oxide and organometallic coating on the ferrous metal substrate which meets a desired specification.

The ferrous metal coating formed by the process is improved if the surface of the uncoated ferrous metal is essentially free of oxides, surface dirt, grease, oil, and scale prior to the coating process. Rinsing the uncoated substrate with water to remove cleaning residues also enhances the coating. Rinsing the coated substrate with water to remove coating bath residues improves the appearance of the coated substrate and improves the coating's ability to retain a topcoat. Thus other embodiments of the process also comprise one or more of the steps of (a) cleaning the uncoated ferrous metal substrate by, for example, immersion in an alkaline soak cleaner, (b) rinsing the uncoated ferrous metal substrate in water, (c) rinsing the coated ferrous metal substrate in water, and (d) application of an appropriate rust preventive, lubricant, or polymer-based topcoat to the coated ferrous metal substrate.

An embodiment of the process of making the bath composition comprises the steps of mixing with water, in any order, (a) an aluminum salt, (b) organic acid, and (c) an oxidizer, to form a bath composition with a pH of about 1 to about 2. Another embodiment of the process of making the bath composition also comprises the step of adjusting the pH upward, in the range of about 3 to about 5, after the aluminum salt, organic acid, and oxidizer are fully dissociated. A further embodiment of the process of making the bath composition comprises the step of adjusting the pH upward, in the range of about 4 to about 5. The upward adjustment may be made using sodium or potassium hydroxide. The pH of the fully dissociated bath composition depends on which polycarboxylic acid is used. If the pH is adjusted before the organic acid is added, insoluble poly-aluminates are formed in the bath composition and efficacy of the composition is diminished.

Raising and maintaining the pH of the composition in a range of about 3 to about 5 improves coating quality. Raising and maintaining the pH of the composition in a range of about 4 to about 5 further improves coating quality. Without the upward pH adjustment, EDS analysis discloses that the ferrous metal coating tends to be thin, gray colored, and composed mainly of iron oxides. Corrosion resistance of such coatings is diminished.

The process bath generates only a light floe precipitate during operation. Consequently, descaling of tanks and heaters is normally not necessary; however, filtration of the bath is advisable, using a 50-100 micron filter element, to remove particulates.

In many applications, the process utilizes five steps and takes about 16 minutes. An embodiment of the process comprises the following steps:

1. Cleaning the substrate in a suitable metal cleaning cycle to produce a surface that is essentially free of extraneous oils and oxides.
2. Rinsing the substrate in clean water to remove cleaning residues.
3. Coating the substrate by immersion in the bath composition for 10 minutes at 160° F.
4. Rinsing the coated substrate in clean water to remove bath residues.
5. Sealing the coated substrate with a functional or decorative topcoat appropriate to the intended end-use of the article. This may be a material that prevents rusting, (such as an oil or wax), or that provides lubricity, (such as a stearate or other stamping or forming lubricant) or a decorative topcoat, (such as a paint coating), or other topcoats that provide useful properties to the final finish.

As is commonly known to those skilled in metal finishing techniques, articles to be coated are carried through the process in a manner that avoids "flat against flat" contact in order to ensure uniform chemical contact on all surfaces. Large substrates can be individually racked or carried in a wire basket. Multiple smaller articles can also be processed in a basket or in a cylindrical perforated barrel, rotating at 1-2 rpm. The basket or barrel can be constructed of, for example, polypropylene or stainless steel.

During the initial heat-up and operation of an immersion bath, some stratification of warm and cooler layers of bath composition may occur as a result of the location of the heating element and thermocouple. Since lower temperatures can affect the speed of the reaction, the bath should be circulated by means of an acid-proof pump or impeller.

Some substrates may carry pre-existing oxides on the surface in the form of mill-scale, heat treat scale, or rust. Coating quality is improved if the substrates are descaled prior to coating. Descaling can be accomplished by abrasive cleaning methods such as bead blasting or shot blasting, or by chemical means such as a chemical descaling solution.

During the course of normal operation, the bath composition's constituents are gradually consumed. In addition, there will be some water loss due to evaporation. These components must be replaced on a regular basis in order to keep the bath operating normally. The normal operating level of the bath should be maintained through regular additions of water. Once the normal operating level is restored, the bath composition can be titrated to determine its concentration and replenished as necessary to maintain normal operating concentration.

Coating Process Variables

The reaction rate of the ferrous metal substrate with the bath composition is directly proportional to: (a) the concentration of aluminum in the bath composition, (b) the molar concentration of the accelerator, and (c) the temperature of the bath composition.

An embodiment of the bath composition forms acceptable coatings at aluminum concentrations in the range of about 0.01 M up to about the solubility limit of the salt. Another embodiment forms higher quality coatings at a reasonable reaction rate at concentrations in the range of about 0.01 to about 0.10 M. An embodiment with concentrations in the range of about 0.02 to about 0.05 M produce better quality coatings at a reasonable reaction rate on most ferrous metal surfaces.

An embodiment of the bath composition forms acceptable coatings at accelerator concentrations in the range of about 0.01 M to about 0.20 M. Another embodiment of the bath composition forms higher quality coatings at accelerator concentrations in the range of about 0.01 M to about 0.05 M. Accelerator concentrations in excess of about 0.20 M produce coatings that are progressively less adherent as the concentration and the concomitant deposition rate increases. Accelerator concentrations less than about 0.01 M produce coatings at rates that are too slow for practical use.

An embodiment of the bath composition forms acceptable coatings at a temperature in the range of about 100 to about 180° F. with a pH in the range of about 3 to about 5. Another embodiment forms higher quality coatings at a temperature in the range of about 130 to about 160° F. In the range of about 130 to about 160° F., smooth, darker gray coatings are produced in about 5 to about 10 minutes on most ferrous metal surfaces. At temperatures below about 100° F., the reaction rate is slow and little coating is produced by the process. Above about 180° F., the reaction rate is rapid and a non-adherent coating is deposited on some ferrous metal surfaces. Another embodiment of the coating process comprises a bath composition at a temperature in the range of about 120 to about 160° F., and a pH in the range of about 4 to about 5. Increasing the contact time of the ferrous metal substrate with the bath composition increases the weight of the coating. Coatings formed during a contact time from about 5 to about 40 minutes were found to be of good quality.

An embodiment of the process operates at about 150° to 160 degrees Fahrenheit and at a pH of about 5.0. At this temperature, the process produced a highly absorbent gray coating, 0.000040 inches thick, and tightly bonded to the surface of the substrate. The high absorbency of the coating anchors paint finishes, oils, stearates, and other compounds. Thus, the coating acts as an effective break-in lubricant and stamping lubricant.

Coating characteristics vary as the molar ratio of acid to aluminum of the bath composition changes. An embodiment of the bath composition uses oxalic acid at a molar ratio of oxalic acid to aluminum in the range of about 1.5 to about 4. Another embodiment uses oxalic acid at a molar ratio of oxalic acid to aluminum in the range of about 2 to about 2.5, which produces higher quality dark gray coatings. Molar ratios of acid to aluminum higher than about 2.5 produce a yellow colored coating containing a predominance of iron oxalate. Molar ratios lower than about 1.5 produce a brown colored coating composed mainly of iron oxides.

The pH of the bath composition rises during the ferrous metal coating process. As the pH rises, the composition produces a precipitate. By adjusting the pH downward during the process, the precipitate dissolves and the composition clarifies. In an embodiment, an operating pH is when the bath composition begins to clarify.

Coating Composition

A conversion coating of about 1 micron thickness (dimensionally insignificant in many applications) is deposited on a ferrous metal surface when it is processed by the bath composition. The coating is porous, i.e., it has relief. The porosity increases the actual surface area of the coated ferrous metal substrate and enhances adherence of a subsequently applied functional or decorative topcoat. The conversion coating is generally (a) smooth to the touch, (b) glossy and smooth in appearance, and (c) gray colored.

Analysis by energy dispersive x-ray spectroscopy (EDS) and scanning electron spectroscopy (SDS) indicates that the coating of an embodiment is comprised of a mixture of aluminum oxides, aluminum oxalate, iron oxides, and iron oxalate. FIG. 1 is a scanning electron micrograph (SEM) of an embodiment of the conversion coating at 5000× magnification. It confirms that the coating (a) retains its smooth appearance, (b) sometimes exhibits a fractured or micro cracked surface, and (c) lacks a well-defined crystalline structure.

Figure 2:
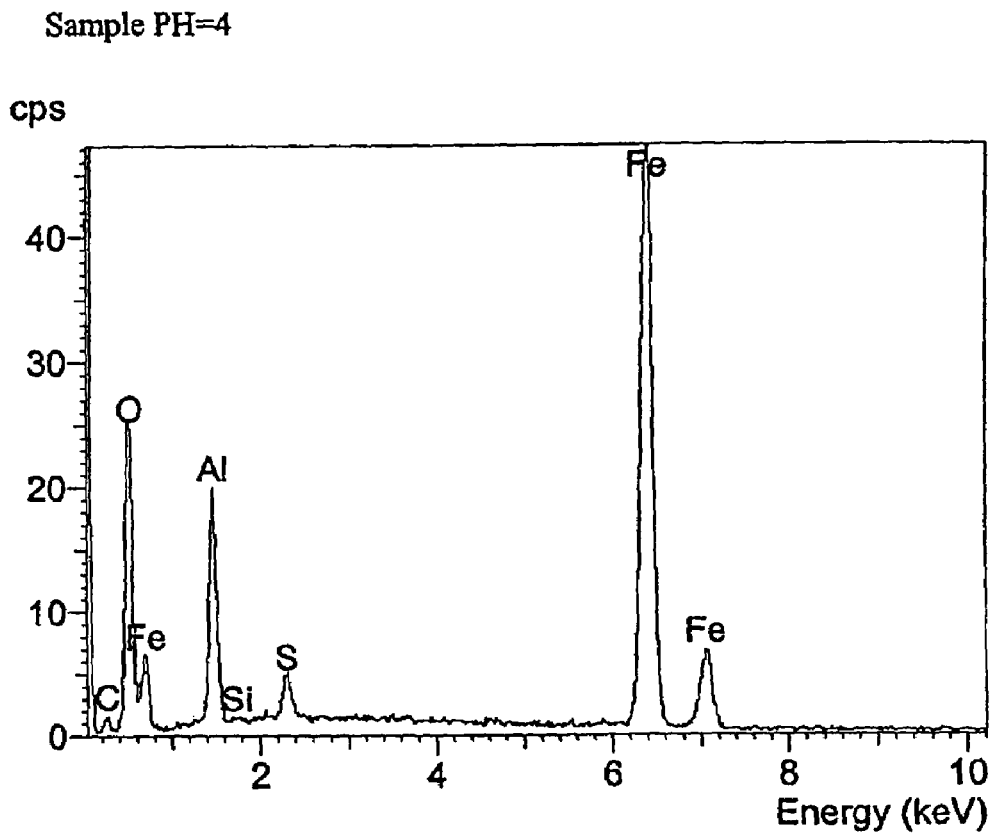
FIG. 2 is an energy dispersive x-ray spectroscopy of an embodiment of the conversion coating.

Analysis by energy dispersive x-ray spectroscopy (EDS) indicates the presence of aluminum, iron, sulfur, carbon, and oxygen. FIG. 2 is an EDS spectrum of an embodiment of the conversion coating.

Analysis of the surface chemistry of the coating by electron spectroscopy for chemical analysis (ESCA), also known as x-ray photoelectron spectroscopy (XPS), indicates that (a) aluminum and iron are bound to oxygen, (b) sulfur is present in the form of sulfate, and (c) carbon is present primarily in the form of oxalate. FIG. 3 presents a summary of the ESCA data, which supports the foregoing ESCA analysis. FIG. 3 includes Tables 1 and 2. Table 1 presents a summary of the atomic concentration for two embodiments of the coating. Table 2 presents a summary of the carbon chemistry of the embodiments. One embodiment of the coated ferrous metal substrate was processed for 20 minutes in the bath composition and another for 40 minutes. The 40 minute coating is a thicker coating than is the coating processed for 20 minutes. Quantitative analysis of the coating solution indicates that aluminum and oxalic acid are both consumed during the coating process, which further confirms the deposition of aluminum and oxalate as part of the coating.

XPS analysis suggests a possible empirical formula of: $Al_{20}Fe_3C_{18}S_3O_{76}$, though these ratios may vary somewhat depending on reaction conditions. Such a formula indicates a mixture of (a) aluminum oxide, $Al_2O_3$; (b) aluminum oxalate, $Al_2(C_2O_4)_3$; (c) iron oxalate, $FeC_2O_4$; (d) iron oxides, FeO; (e) iron; and (f) aluminum sulfate. X-ray diffraction (XRD) analysis, which determines the structure of crystals, only detected the presence of iron oxides. Therefore, the aluminum compounds within the conversion coating are believed to be amorphous. The lack of crystalline iron oxalate in the coating is unexpected, since it generally forms easily on most ferrous metal substrates in acidic solutions. The conversion coating most likely contains water, the loss of which may be the cause of the fractured surface. As a result, the amount of oxygen in the coating changes with time and cannot be determined accurately.

Test Results

Various ferrous metal products were coated by an embodiment of the coating process described in this specification. FIG. 2 is a table of process and coating parameters for a wheel brake cylinder casting, powdered metal gear sprocket, steel slotted L-stamping, forged tie rod end, ½ inch hexagonal nut, and ¼ inch polished steel tubing. The ferrous metal products were coated with an embodiment of a bath composition comprising: (a) water, (b) aluminum sulfate, $Al_2(SO_4)_3.18H_2O$ at a concentration of about 15 grams per liter of water; (c) oxalic acid, $(COOH)_2$ at a concentration of about 10 grams per liter of water; (d) sodium m-nitrobenzenesulfonate at a concentration of about 3 grams per liter of water; and (e) ferrous sulfate, $FeSO_4$ at a concentration of about 0.1 grams per liter of water. The molar ratio of oxalic acid to aluminum was about 2.5. The pH of the bath composition was adjusted to about 4.0 with liquid sodium hydroxide. The ferrous sulfate is a source of soluble iron (II), which accelerates break-in of the bath composition.

Prior to coating, the products were degreased in a heated alkaline soak bath to remove oil, grease, and other surface contaminants. Cleaning was followed by a water rinse to remove residues of the alkaline cleaner and other soils. After coating, the color and weight of the conversion coating was analyzed. Corrosion resistance of painted and unpainted conversion coated steel panels were also analyzed.

The tests indicate that:

Corrosion resistance of the conversion coated ferrous metal substrate with a rust preventive or paint topcoat exceeds that of comparable iron phosphate conversion coatings with a rust preventative or paint topcoat.

The coating is stable to at least 930° F.

The inherent gloss of the coating is durable.

Durability of the coating gloss is desirable for decorative applications. The heat test was conducted on a steel panel with one-half coated by the process of an embodiment and the other half uncoated. The steel panel was then heated in air to about 930° F. A flaky oxide scale formed on the uncoated area. However, the coated area was unaffected, except for slight darkening. The coating color ranged from gray to gray-black (FIG. 4).

FIG. 5 presents the weight (mg/ft$^2$) of the conversion coating produced using this embodiment of the bath composition. The weight is presented as a function of the bath composition temperature and contact time. Determinations were made on 3×6 inch steel panels of 1018 steel (0.25 ft$^2$ total surface area). Before coating, the panels were pre-cleaned for about 20 minutes in an alkaline soak cleaning composition at about 140° F. They were then rinsed in water for about 1 minute until a water break-free surface was achieved. The panels were then immersed in the bath composition for 10 minutes. After coating, the panels were given a thorough clean water rinse and then force dried at room temperature. The panels were then weighed to about the nearest 0.1 milligram and stripped of the coating using a bath containing about 50 g/L NaOH and about 5 g/L sodium gluconate for a period of about 30 minutes at about 150° Fahrenheit. Following another water rinse, the panels were dried and weighed.

The results of corrosion resistance testing are presented in FIG. 6. Salt fog corrosion testing revealed that the corrosion resistance of the ferrous metal substrate is enhanced when sealed with a rust preventative sealant. The corrosion resistance exceeded those achieved for both black oxide and iron phosphate coatings.

Corrosion resistance of the coating produced using the bath composition of this embodiment was determined in neutral salt fog (about 5% neutral salt fog at about 95 ± about 2° F. and about 100% relative humidity). Standard 1018 steel test panels were used as test specimens. The salt fog tests were conducted in compliance with ASTM B-117.

For comparison purposes, the corrosion protection of the metal oxide/organometallic conversion coating was compared to that of panels treated with a conventional iron and zinc phosphate conversion coating. The iron phosphate coating was formed by immersing the panels for about 5 minutes at about 130° F. in a conventional iron phosphatizing composition. The zinc phosphate coating was formed by immersing the panels for about 10 minutes at about 180° F. in a conventional zinc phosphatizing composition.

The coated panels were dried and sealed by immersing for about 3 minutes in either a water-displacing solvent-based sealant (WD) or a water-soluble oil (WS). The water displacing sealant was used without dilution; the water soluble oil was used at about 15% (by volume) concentration and at about 130° F. The panels were then allowed to dry for about 72 hours.

Once dry, the panels were placed in a salt fog chamber and tested in accordance with ASTM B-117. The endpoint of the test was reached when >10% of the surface exhibited red rust.

An increase in the corrosion resistance of the ferrous metal substrates coated with the bath composition of this embodiment is supported by the data in FIG. 6. The greatest increase in corrosion resistance occurs when the coated product is sealed with various rust preventive topcoats.

The ability of the metal oxide/organometallic conversion coating to act as an absorbent paint base was evaluated by coating several 3×6 inch Q-panels, then painting them with an alkyl air-dry enamel with dry film thicknesses ranging from about 0.7 to about 1.8 mils. The adhesion of the paint to the conversion coating was then evaluated by performing the Cross Hatch Tape Pull test, as specified by standard test method ASTM D 3359-02, and compared with a painted panel that had received no pretreatment. The metal oxide/organometallic conversion coating demonstrated improved paint adhesion when compared to surfaces without the coating.

Further Embodiments

In an embodiment, the invention includes a process for making a bath composition, comprising the steps of: (a) dissolving the following in water (i) aluminum sulfate at a concentration of about 10 to about 30 grams per liter of solution, (ii) oxalic acid at a molar ratio of oxalic acid to aluminum sulfate in the range of about 1.5 to about 4, (iii) nitrobenzenesulfonic acid at a concentration of about 2 to about 4 grams per liter of solution; (b) adjusting the pH into the range of about 3 to about 5 by adding sodium hydroxide after the aluminum sulfate, oxalic acid, and nitrobenzenesulfonic acid are fully dissociated in the water; and (c) adding ferrous sulfate at a concentration of about 0.1 to about 0.5 grams per liter of solution.

This a process of forming a conversion coating on ferrous metal substrates, the composition of the conversion coating, the composition of the bath used in the process of coating ferrous metal substrates, and the coated ferrous metal substrates made by the process is provided. One skilled in the art will appreciate that the inventions of the claims that follow can be practiced by other than the described embodiments, which are presented for purposes of illustration and not limitation. Consequently, the inventions are limited only by the claims that follow.

We claim:

1. A process for making a bath composition, comprising the steps of:

(a) dissolving the following in water (i) aluminum sulfate at a concentration of about 10 to about 30 grams per liter of solution, (ii) oxalic acid at a molar ratio of oxalic acid to aluminum sulfate in the range of about 1.5 to about 4, (iii) nitrobenzenesulfonic acid at a concentration of about 2 to about 4 grams per liter of solution;

(b) adjusting the pH into the range of about 3 to about 5 by adding sodium hydroxide after the aluminum sulfate, oxalic acid, and nitrobenzenesulfonic acid are fully dissociated in the water; and (c) adding ferrous sulfate at a concentration of about 0.1 to about 0.5 grams per liter of solution.

* * * * *